United States Patent [19]

Tsutsumi et al.

[11] 4,250,375

[45] Feb. 10, 1981

[54] THERMAL RECORDING HEAD

[75] Inventors: Tadashi Tsutsumi, Naritanishi; Mamoru Mizuguchi, Yokohama, both of Japan

[73] Assignee: Tokyo Shibaura Denki Kabushiki Kaisha, Kawasaki, Japan

[21] Appl. No.: 45,933

[22] Filed: Jun. 6, 1979

[30] Foreign Application Priority Data

Jun. 14, 1978 [JP] Japan ..... 53-70740

[51] Int. Cl.[3] ..... H05B 1/00

[52] U.S. Cl. ..... 219/216; 219/543; 338/308; 346/76 R

[58] Field of Search ..... 219/216, 543; 338/287, 338/308, 309; 346/76 R, 154; 29/620

[56] References Cited

U.S. PATENT DOCUMENTS

| | | | |
|---|---|---|---|
| 4,136,274 | 1/1979 | Shibata et al. | 219/216 |
| 4,138,605 | 2/1979 | Stapleton et al. | 219/216 |
| 4,141,018 | 2/1979 | Mizuguchi et al. | 346/76 R |
| 4,194,108 | 3/1980 | Nakajima et al. | 219/216 |

FOREIGN PATENT DOCUMENTS

| | | | |
|---|---|---|---|
| 53-31143 | 3/1978 | Japan | 219/216 |

OTHER PUBLICATIONS

"Thermal Printing Head for Fascimile" by Fujio Oda, National Technical Report, vol. 24, No. 4, Aug. 1978, pp. 668–671.

*Primary Examiner*—Volodymyr Y. Mayewsky
*Attorney, Agent, or Firm*—Oblon, Fisher, Spivak, McClelland & Maier

[57] ABSTRACT

A thermal recording head which comprises a plurality of heat-generating resistors; an insulation substrate on which a plurality of separate conductors are mounted to be connected to the heat-generating resistors directly or with diodes interposed therebetween; and a 3-ply conductor holder formed of an insulation sheet, an assembly of common conductors mounted on the insulation sheet at a prescribed interval and an insulation layer deposited on the common conductors with a thickness of 2 to 20 microns, and wherein the insulation layer has openings arranged at a prescribed interval; and the insulation substrate is laminated with the conductor holder with the common conductors connected to the separate conductors.

4 Claims, 15 Drawing Figures

THERMAL RECORDING HEAD

This invention relates to a thermal recording head used with a data-recording device such as a facsimile recorder.

This type of thermal recording head comprises a large number of (for example, hundreds of) linearly arranged heat-generating resistors, and in which current is introduced through the selected ones of these resistors to heat the particular parts of a sheet of heat-sensitive paper to produce an image. A known method of simplifying connection between such numerous heat-generating resistors and a driving circuit is to divide a plurality of heat-generating resistors R1, R2 . . . R'1, R'2 . . . R''1, R''2 (as shown in FIG. 1) into groups each having the same n number of heat-generating resistors, and arrange them in the matrix form whose rows and columns each contain an n number of said resistors, in other words, to provide the so-called diode matrix. At the time of recording, a prescribed level of voltage is impressed on one (for example, B1) of a plurality of group position-selecting terminals B1, B2 . . . Any of the picture signal input terminals C1 to Cn is supplied with voltage having a level corresponding to a picture signal to be supplied to any of the resistors R1, R'1 . . . R'''1 of a selected group. To attain the above-mentioned object, it is necessary, as seen from FIG. 1, to provide a multilayer circuit arrangement. If, however, an insulation layer required for said multilayer circuit arrangement is formed by a thin layer-forming method, for example, by sputtering, then short-circuiting is likely to occur in said multilayer circuit arrangement.

To eliminate the above-mentioned drawbacks accompanying, for example, the conventional facsimile recorder, another thermal recording head (a Japanese patent disclosure No. 31143, 1978) was proposed which used an insulation sheet provided with a plurality of slits each having a prescribed shape.

This proposed thermal recording head has the following circuit arrangement. As shown in FIGS. 2(*a*) and 2(*b*), separate conductors l1 to ln, l'1 to l'n . . . for connecting heat-generating resistors to diodes are formed on an insulation substrate 1 in the L-shape. Common copper foil conductors L1 to Ln provided with slits 2 are mounted on an insulation sheat 3 in a state separated from each other at a prescribed interval, thereby providing a flexible sheet 4. This flexible sheet 4 is connected to the insulation substrate 1, so that the common copper foil conductors L1 to Ln are superposed on the separate conductor l1 to ln, l'1 to l'n . . . An insulation sheet 3 (FIG. 2*b*) is laid between the common copper fold conductors L1 to Ln and separate conductors l1 to ln, l'1 to l'n . . . Both types of conductor are connected together at the slits, for example, by solder.

The thermal recording head of the patent disclosure No. 31143, 1978 constructed as described above can indeed more simplify the process of manufacturing a thermal recording head and more reduce its cost than the aforesaid prior art multilayer type, but is still accompanied with the following drawbacks.

The common copper foil conductors L1 to Ln are supported on the insulation sheet 3, which, therefore, can not help being made relatively thick. Actually, the insulation sheet 3 is made as thick as about 50 microns (as set forth in the aforesaid Japanese patent disclosure No. 31143, 1978). For connection to the separate conductors l1 to ln, l'1 to l'n, l''1 to l''n . . . , the common copper foil conductors L1 to Ln have to be curved or bent to an extent equal to the thickness of the insulation sheet 3 (FIG. 2*b*). If the insulation sheet 3 is made as thick as described above, then difficulties will arise in bending the copper foil conductor L1 to Ln due to the particular properties of the material thereof, connection between both types of conductors is likely to fail sometimes. Generally, the recording density of a thermal redording head is of the order of 6 to 8 lines/mm. Consequently the separate conductors l1 to ln, l'1 to l'n, l''1 to l''n . . . are formed on and the insulation substrate 1 at as narrow an interval as 125 to 167 microns. Therefore, it is desired to reduce the width of the slits 2 in order to suppress the occurrence of short circuiting among the adjacent conductors formed on the insulation substrate 1. If it is attempted to decrease the width of the slits 2, then difficulties will be presented in connecting the common copper foil conductor L1 to Ln and the separate conductors l1 to ln, l'1 to l'n, l''1 to l''n . . . Even after said connection is effected, the spring action of the common copper foil conductors L1 to Ln will render said connection less reliable.

It is accordingly the object of this invention to provide a thermal recording head which allows for high density recording and ensures the more reliable line connections of a drive circuit.

To attain this object, a thermal recording head embodying this invention comprises an insulation substrate; a plurality of heat-generating resistors mounted on the insulation substrate; a plurality of separate conductors set on the insulation substrate so as to be connected to the resistors directly or through diodes; a holder member for supporting common conductors connected to the separate conductors, wherein the common conductor holder member has a three-ply construction consisting of an insulation sheet, common conductors spatially arranged on the insulation sheet, and an insulation film deposited on the common conductors with a thickness of 2 to 20 microns and provided with a plurality of spatially arranged openings; and the common conductors are connected to the separate conductors through the openings of the insulation film.

This invention can be more fully understood from the following detailed description when taken in conjunction with the accompanying drawings, in which:

FIG. 1 shows the circuit arrangement of the prior art thermal recording head;

FIG. 2*a* is front view of the line connection pattern of the prior art thermal recording head having the circuit arrangement of FIG. 1.

FIG. 2*b* is a sectional view on line B—B of FIG. 2*a;*

Figure 5A:
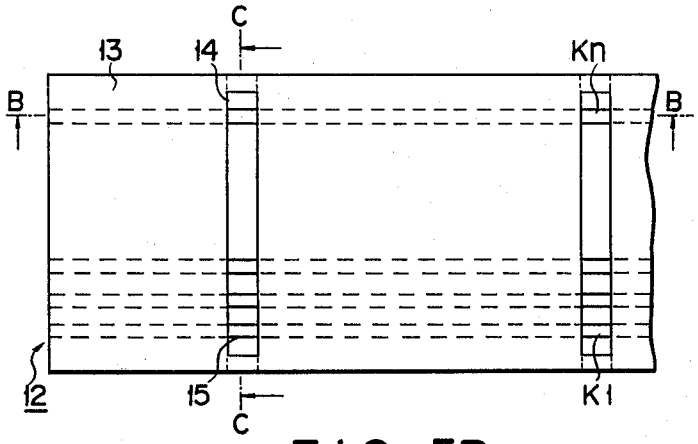
Figure 5C:
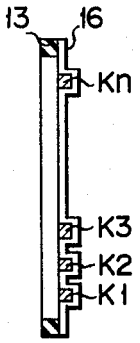
Figure 5B:
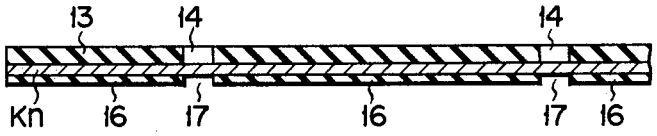

FIG. 5*a* is a plan view of a flexible tape lead used with the thermal recording head of the invention;

FIG. 5*b* is a sectional view on line B—B of FIG. 5*a;*

FIG. 5*c* is a sectional view on line C—C of FIG. 5*a;*

Figure 6A:
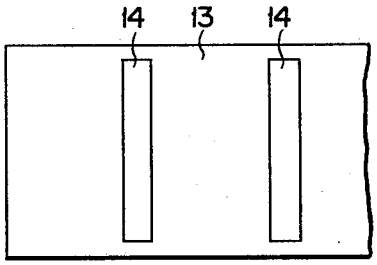
Figure 6B:
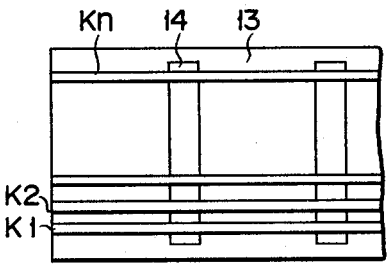
Figure 6C:
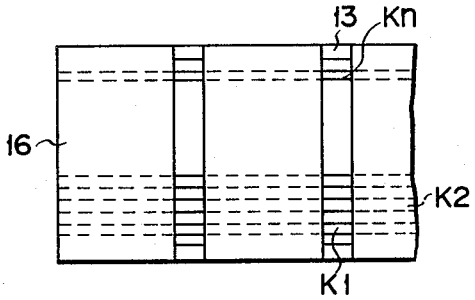

FIGS. 6*a*, 6*b* and 6*c* are plan views showing the sequential steps of manufacturing the flexible tape lead of FIGS. 5*a*, 5*b* and 5*c;*

Figure 7A:
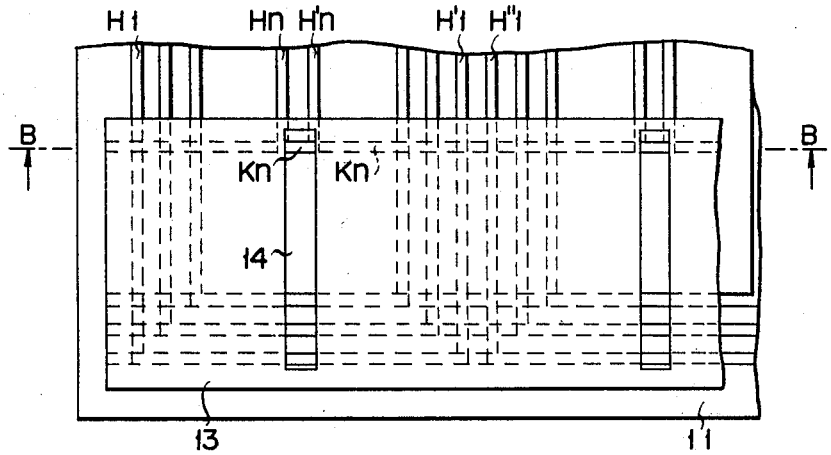
Figure 7B:
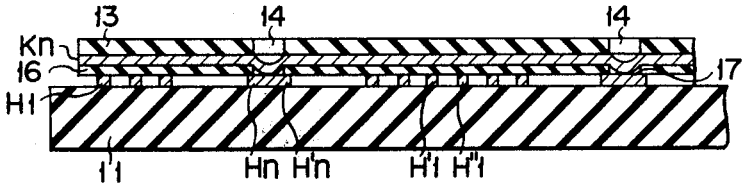

FIG. 7*a* is a plan view of the circuit arrangement of a thermal recording head according to another embodiment of the invention;

FIG. 7*b* is a sectional view or line B—B of FIG. 7*a*; and

Figure 8A:
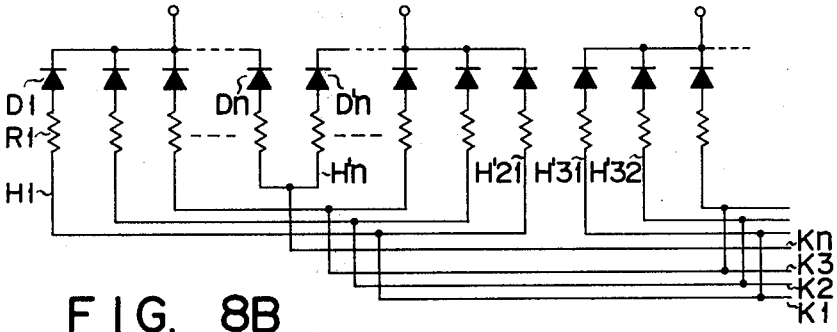
Figure 8B:
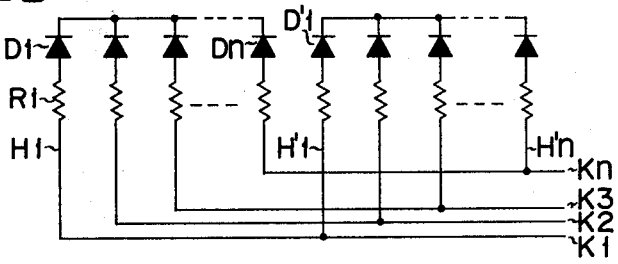

FIGS. 8*a* and 8*b* show the circuit arrangements of thermal recording heads according to other embodiments of the invention.

There will now be described by reference to FIG. 3 the circuit arrangement of a thermal recording head according to one embodiment of this invention. With this embodiment, a large member of series-connected heat-generating resistors and the corresponding diodes are divided into a plurality of groups each consisting of the same number of these resistors and diodes. The elements of every two adjacent groups disposed symmetrically with respect to a border line between said groups are connected together. Separate conductors which connect in symmetrically arranged resistors and similary symmetrically arranged diodes of every two groups and occupy the identical symmetrical positions among said every two groups are connected together by common conductors.

The resistors R1 to Rn of the first group G1 are connected to diodes D1 to Dn to suppress a back flow of an electric current. The separate conductors H1 to Hn of the first group G1 are connected to the separate conductors H'1 to H'n of the second group G2 with the diodes D1 to Dn of the first group G1 symmetrically set with the diodes D'1 to D'n of the second group G2 respectively connected to the heat-generating resistors R'1 to R'n of said second group G2. The resistors and diodes of the third and fourth groups G3, G4 and the corresponding separate conductors are connected in the same manner as described in connection with the first and second groups G1, G2. The separate conductors of every two groups are connected to the corresponding common conductors K1 to Kn. For example, the separate conductor H1 of the first group G1 and the separate conductor H'1 of the second group G2 are connected to the common conductor K1. Similarly, the separate conductor H''1 of the third group G3 and the separate conductor H'''1 of the fourth group G4 are connected to said common conductor K1.

Figure 4:
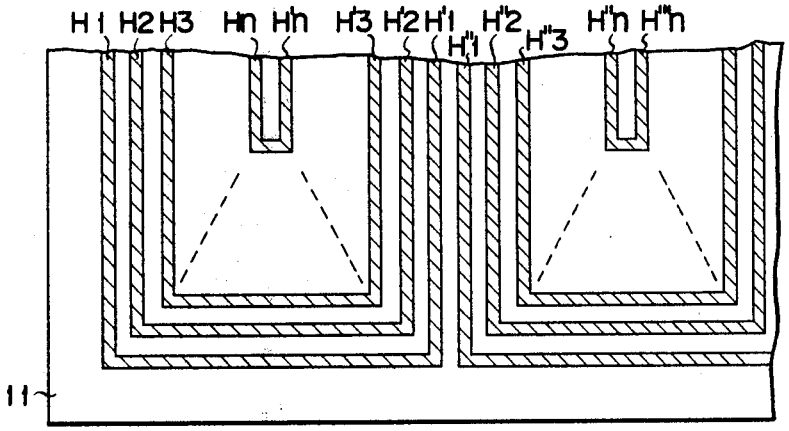
FIG. 4 is a plan view of an insulation substrate included in the thermal recording head of the invention.

The circuit arrangement of a thermal recording head is formed, as fractionally illustrated in FIG. 4, by sputter-depositing on an insulation substrate heat-generating resistors (not shown), and separate conductors H1 to Hn, H'1 to H'n, H''1 to H''n, H'''1 to H'''n by a thin layer-forming technique such as the vacuum deposition of a metal accompanied with photoetching.

The undermentioned conductor holder 12 (FIG. 5*a*) such as a flexible tape lead is mounted on the separate conductors deposited on the insulation substrate 11 to provide a prescribed circuit. This flexible tape lead 12 has a three-ply construction as illustrated in FIG. 5 (*b*). The flexible tape lead 12 is manufactured by the steps of cutting out crosswise extending rectangular windows 14 at a prescribed interval in an insulation sheet 13 prepared from a flexible insulating material with a greater thickness than, for example, 50 microns (FIGS. 5*a*, 5*b*); mounting at a prescribed interval lengthwise extending copper foil conductors 15 (K1 to Kn) which intersect the crosswise extending rectangular windows 14 at right angles; and thermally depositing an insulation layer 16 except for these portions of common copper foil conductor 15 which face the crosswise extending rectangular windows 14 formed in the insulation sheet 13. The insulation layer 16 are provided with crosswise extending rectangular openings 17 shaped like the crosswise extending rectangular windows 14 of the insulation sheet 13 at points facing said windows 14. In the embodiment of FIGS. 5*a*, 5*b* and 5*c*, the crosswise, extending rectangular openings 17 of the insulation layer 16 are chosen to have the same width as the crosswise extending rectangular windows 14 of the insulation sheet 13. However, the rectangular openings 17 may be narrower or wider than the rectangular windows 14. Further, the rectangular openings 17 of the insulation layer 16 may be cut out crosswise throughout the insulation layer 16, or both end edges of said rectangular opening 17 may terminate at points lying inside of both lateral sides of the insulation layer 16.

The flexible tape lead 12 may be manufactured, for example, in the following manner. As illustrated in FIG. 6*a*, crosswise extending rectangular windows 14 having a thickness of 1 to 2 mm are punched at a prescribed interval in a polyimide resin film which has a thickness of 125 microns, and to whose surface an adhesive is applied. A copper foil is uniformly laminated with the perforated polyimide resin film by means of the adhesive. The copper foil is partly etched to form, as shown in FIG. 6*b*, a plurality of common copper foil band conductors K1 to Kn, for example, with a width of 100 microns and at an interval of 100 microns. An insulation layer 16 prepared from, for example, melamine resin, epoxy resin, or polyimide resin is coated to a thickness of 2 to 20 microns over the laminated mass, except for the crosswise extending windows 14 of the tape lead 12. The insulation layer 16 may be formed by the screen printing process. Or it is possible to use a resin film which has a proper thickness and is provided with openings at points corresponding to the crosswise extending windows 14 of the tape lead 12, and laminate the punched resin film with the copper foil conductors K1 to Kn. Thus, the flexible tape lead 12 is made into a 3-ply laminate consisting of the insulation sheet 13, copper foil conductor assembly K and insulation layer 16. With the tape lead 12 manufactured by the above-mentioned process, the openings 17 of the insulation layer 16 and the windows 14 of the insulation sheet 13 are aligned with each other. Therefore, separate conductors H1 to Hn, H'1 to H'n, H''1 to H''n, H'''1 to H'''n . . . and common copper foil conductors K1 to Kn are easily connected, for example, by solder, as seen from FIG. 7*a*, and 7*b*.

With the foregoing embodiment, the insulation sheet 13 of the flexible tape lead 12 plays the role of mechanically supporting the common copper foil conductors K1 to Kn and maintaining the their dimensional precision during the manufacture of the flexible tape lead 12 and its connection to the insulation substrate 11. The insulation layer 16, though made considerably thin, ensures electric insulation between the separate conductors H1 to Hn, H'1 to H'n, H''1 to H''n, H'''1 to H'''n . . . and common foil conductors K1 to Kn which is required when the flexible tape lead 12 is fixed to the insulation substrate 11.

With the above-mentioned embodiment, the crosswise extending openings 17 of the insulation layer 16 and the crosswise extending windows 14 of the insulation sheet 13 are chosen to have substantially the same width. Since the insulation layer 16 is as thin as 2 to 20 microns, any light deformation or curving of the common copper foil conductors K1 to Kn toward the separate conductors H1 to Hn, H'1 to H'n, H''1 to H''n, H'''1 to H'''n at the aforesaid windows 14 or openings 17 ensures reliable contact between both groups of elements. Therefore, even if the crosswise extending openings 17 of the insulation layer 16 is made as narrow as 0.1 to 1 mm, reliable connection is ensured between the separate conductor and common conductors through the deformation or bending of the latter at the slits 14, 17, without the posibility of undesirable short-circuiting, due to the high dimensioned precision of the common conductors. In other words, high density recording is ensured without the possibility that bad line connection or short-circuiting might arise from the high density with which heat-generating resistors generally have to be arranged.

With a thermal recording head embodying this invention, the common copper foil conductors have only to be deformed or bent to a far smaller extent to ensure contact between said copper foil conductors and separate conductors than has been required for the prior art thermal recording head, whether the common conductor and separate conductors are connected by metal-to-metal thermocompression deposition or by soldering. Therefore, it is possible to resolve the problem of loosened contact between both groups of conductors after they have been connected.

Figure 1:
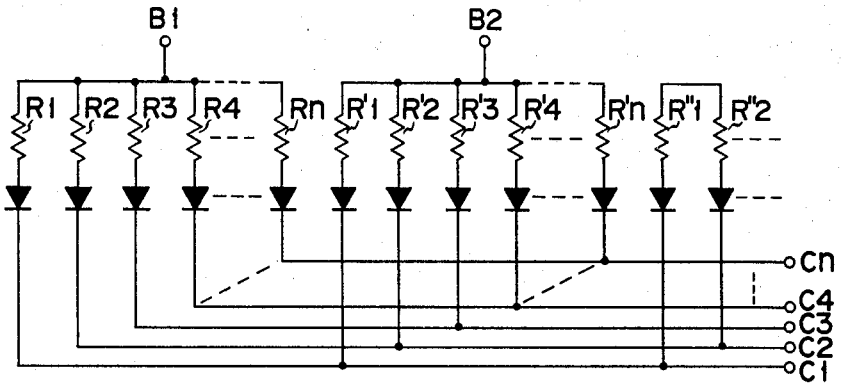
FIG. 1 PRIOR ART
Figure 2A:
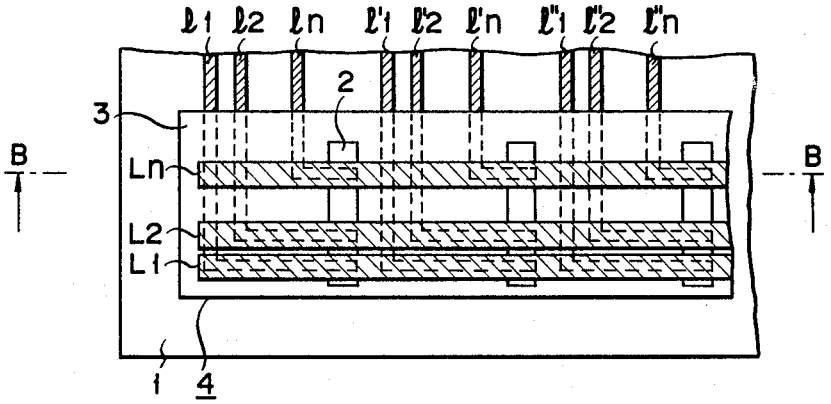
FIG. 2A PRIOR ART
Figure 2B:
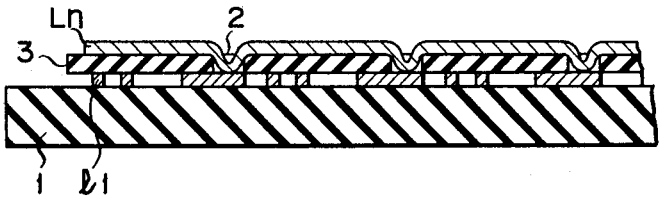
FIG. 2B PRIOR ART

With a flexible tape lead having the shape indicated in the aforesaid Japanese patent disclosure (No. 31143, 1978), the lead Ln undergoes a great stress, as seen from FIG. 2*b*, in connecting said lead Ln to a line ln mounted on the substrate, and consequently tends to be easily broken.

For example, where, in FIG. 2*b*, the insulation sheet 3 was prepared from a polyimide resin film having a thickness of 50 microns, the crosswise extending windows 2 of said insulation sheet 3 where chosen to have a width of 1 mm, and the lead Ln was connected to the separate conductors l1 to ln, l'1 to l'n, l''1 to l''n . . . , then the percentage occurrence of the breakage of said lead Ln at its junction with the separate conductors was measured to be approximately 1%. Consequently, where conductors included in a single substrate are connected at hundreds of points as in a thermal recording head, then such a thermal recording head is manufactured with an extremely low yield. Where conductors mounted on a single substrate are connected, for example, at 300 points, then the probability of obtaining a qualified product falls to about 5% ($0.99^{300} \approx 0.05$). When tested in the same manner as described in connection with the prior art case, a thermal recording head embodying this invention in which the insulation layer 16 was chosen to have a thickness of ten and odd microns indicated a lower degree of line breakage than 0.01%. Accordingly, a qualified thermal recording head embodying this invention in which conductors formed on a single substrate were connected, for example, at 300 points was produced with a higher yield than about 97% ($0.9999^{300} \approx 0.97$), proving that this invention prominently elevated a yield of product.

Figure 3:
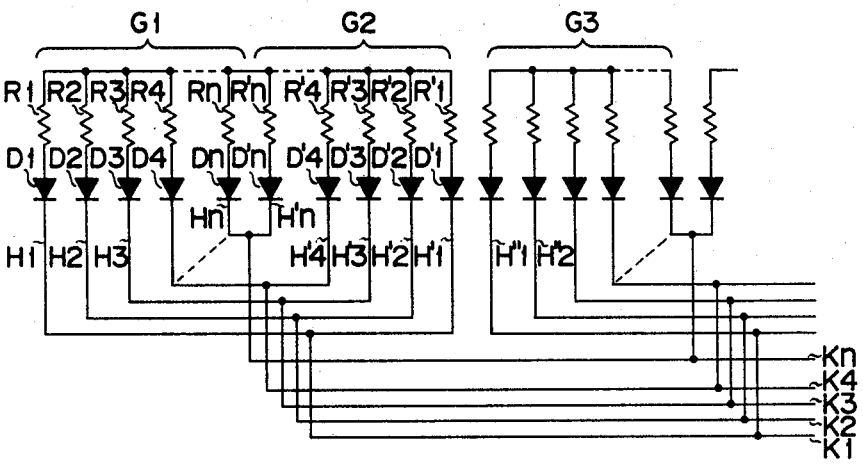
FIG. 3 shows the circuit arrangement of a thermal recording head embodying this invention.

The foregoing description relates to a thermal recording head having the circuit arrangement of FIG. 3. Where this invention is applied to the U-shaped circuit arrangement of FIG. 3, it is possible noticeably to decrease a number of conductor junction and ensure a more reliable connection between the separate conductors and common conductors, advantageously providing a thermal recording head whose operation is extremely reliable despite the dense arrangement of conductors.

The concrete operation of a thermal recording head provided with said U-shaped circuit arrangement was detailed in a patent application Ser. No. 849,425 filed in the United States on Nov. 7, 1977, now abandoned.

Application of this invention is not restricted to a thermal recording head provided with the U-shaped circuit arrangement of FIG. 3. Obviously the invention is applicable to a thermal recording head of any other known type. Further, the invention is applicable not only to the case where diodes for suppressing the back flow of current are connected to the separate conductors, but also to the case where said diodes are connected, as shown in FIGS. 8*a* and 8*b*, on the opposite side of the resistors to the common conductors. The invention is also applicable to a thermal recording head in which the diode matrix is omitted, and heat-generating resistors are separately selected.

With this invention, the crosswise extending rectangular windows 14 are not always for the insulation sheet 13. Where said windows 14 are omitted, it is possible to apply solder to these portions of the common conductors which face the openings of the conductor holder 12 and laminate the common conductors with the separate conductors by means of solder on the insulation substrate 11. Omission of the windows 14 from the insulation sheet 13 offers the advantages that the copper foil conductors are not only formed with a higher dimensional precision, but also have a higher heat conductivity.

As described above, the common conductors of a thermal recoding head embodying this invention are connected to the separate conductors with the insulation layer interposed therebetween. Since the insulation layer is relatively thin, the common conductors can be easily and reliably connected by being deformed or bent only to a very small extent at the openings 17 or windows 14. Since the common conductors are supported on a relatively thick insulation sheet 13, the problems are eliminated that while a thermal recording head is manufactured, the common conductors tend to be arranged at irregular intervals or fail to be connected to the separate conductors or inconvenience is experienced in handling the recording head during its manufacture.

What we claim is:

1. A thermal recording head which comprises an insulation substrate;

a plurality of heat-generating resistors formed on the insulation substrate;

a plurality of separate conductors mounted on the insulation substrate in a state respectively connected to the resistors connected in series with respective diodes; and a conductor holder for supporting common conductor connected to the separate conductors, and wherein the conductor holder includes an insulation sheet, common conductors mounted on the insulation sheet in a state separated from each other at a prescribed interval, and an insulation layer deposited on the common conductors and provided with openings; said insulation sheet included in the conductor holder having windows aligned with the openings of the insulation layer; and the common conductors are connected to the separate conductor through the openings.

2. The thermal recording head according to claim 1, wherein the insulation layer has a thickness ranging between 2 and 20 microns.

3. The thermal recording head according to claim 2, wherein the insulation layer is prepared from a material selected from the group consisting of melamine resin, epoxy resin and polyimide resin.

4. The thermal recording head according to claim 1, wherein the insulation sheet included in the conductor holder has a greater thickness than 50 microns.

* * * * *